US005865629A

United States Patent [19]

Bernardini

[11] Patent Number: 5,865,629

[45] Date of Patent: Feb. 2, 1999

[54] PICK-UP ELEMENTS FOR SLIP RINGS OR ROTARY CONNECTORS

[75] Inventor: Allen J. Bernardini, Southbury, Conn.

[73] Assignee: Litton Systems, Inc., Watertown, Conn.

[21] Appl. No.: 884,988

[22] Filed: Jun. 30, 1997

[51] Int. Cl.[6] ..... H01R 39/00

[52] U.S. Cl. ..... 439/26

[58] Field of Search ..... 439/26, 25, 24, 439/23, 20, 21, 18, 13

[56] References Cited

U.S. PATENT DOCUMENTS 4,143,929 3/1979 Boje et al. ..... 439/26

5,049,083 9/1991 Lin ..... 439/26

*Primary Examiner*—Gary F. Paumen

*Attorney, Agent, or Firm*—Michael H. Wallach

[57] ABSTRACT

A stationary pick-up element for use with a rotary connector having a wire rotary element within a housing. The pick-up element comprises an insulated holder for insertion into a slot in the housing, a plurality of conductive fingers incorporated into the holder and disposed so as to contact the rotary element through an exposed portion of the slot, and end connector incorporated into the holder for connection to a plurality of external wires, and a plurality of conductive traces on the insulated holder for connecting the conductive fingers to the end connector.

13 Claims, 5 Drawing Sheets

PICK-UP ELEMENTS FOR SLIP RINGS OR ROTARY CONNECTORS

FIELD OF THE INVENTION

The present invention relates in general to electrical connectors, and more particularly to a novel pick-up element for slip rings or rotary connectors.

BACKGROUND OF THE INVENTION

It is known in the art to use a set of shaped "fingers"or pick-up elements mounted on a stationary component and adapted to ride in the grooves of a rotary element disposed within the housing of a rotary component. An example of a typical prior art design of pick-up element for slip rings or rotary connectors is shown in FIG. 1. The rotary element 100 is mounted to shaft 110 and disposed within a housing 120 and has a plurality of wires 130 connected to respective conductive grooves 140 of the rotary element 100. Parts 100 to 140 constitute the rotary component of the slip ring or rotary connector.

A connector 150 terminates a further plurality of wires 160 which are individually soldered to a wiring block 170. A plurality of pick-up fingers 180 are manually attached to the fixed element or wiring block 170 via epoxy and are bent to provide a kink or coined area for proper pressure. The pick-up fingers 180 may be fabricated from a gold alloy or any good conductive metal selected for maximum wear and conductivity. Parts 150 to 180 constitute the fixed or stationary component of the slip ring or rotary connector and are dimensioned so as to fit into a slot 190 of the housing 120 which contains the wired rotary element.

In operation, the fingers or pick-up elements 180 ride in the grooves 140 of the rotary element 100 to transform an electrical signal on the wires 160 to the rotary component. As will be appreciated from the drawing of FIG. 1, the stationary and rotary components cannot be "hard-wired" as the wires 160 would twist and break.

Prior art designs such as exemplified by FIG. 1, have been in existence for a long period of time and have been refined to the point where extremely long life (i.e. number of revolutions) has been achieved using the components such as set forth in FIG. 1. Many factors influence the durability and lifetime of such rotary connectors, including the materials used, forces of one component against another, surface finishes of the contacting elements 140 and 180, the amount of current flowing (i.e. amperage) and conductivity of the materials used.

It will be appreciated that manual attachment of the pick-up fingers 180 to the wiring block 170 followed by manual bending to provide proper pressure against the conductive grooves 140 and careful manual fitting of the parts into housing 120 is extremely labor intensive and therefore adds cost to the finished product.

SUMMARY OF THE INVENTION

According to the present invention, a novel design of pick-up elements is provided using low cost, mass production fabrication techniques. In one embodiment of the invention, molding, selective surface plating and wire bonding are used to create the stationary element of a rotary connector having an operating life time and durability commensurate with the prior art. According to a second embodiment which utilizes stamping, molding and heat staking or press fitting, the stationary element of a rotary connector is provided having durability and lifetime which is also commensurate with the prior art. According to third and fourth embodiments of the invention which utilize molding and standard printed circuit board plating techniques, and a specialized flexible circuit, respectively, stationary elements of a rotary connector are provided having of extremely low cost but an anticipated shorter life time than prior art designs.

According to the present invention, in all its embodiments, both the pick-up elements and the external interface connector are incorporated directly into a stationary carrier which is adapted to fit into a slot in the housing. Because mass production techniques are utilized to create a fully integrated stationary element which can be inserted into the housing of the rotary element without additional manual attachment or soldering procedures, the productive costs are much lower that for prior art devices.

BRIEF DESCRIPTION OF THE DRAWINGS

FIG. 4 is a perspective view of the housing portion of the rotary element;

BRIEF DESCRIPTION OF THE INVENTION

Figure 1:
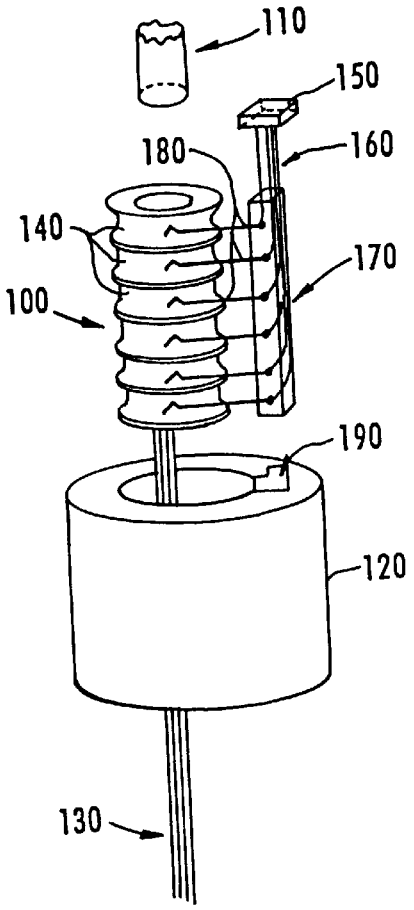
Fig. 1 (PRIOR ART)
FIG. 1 is a schematic representation of a slip ring or rotary connector in accordance with the prior art.
Figure 2:
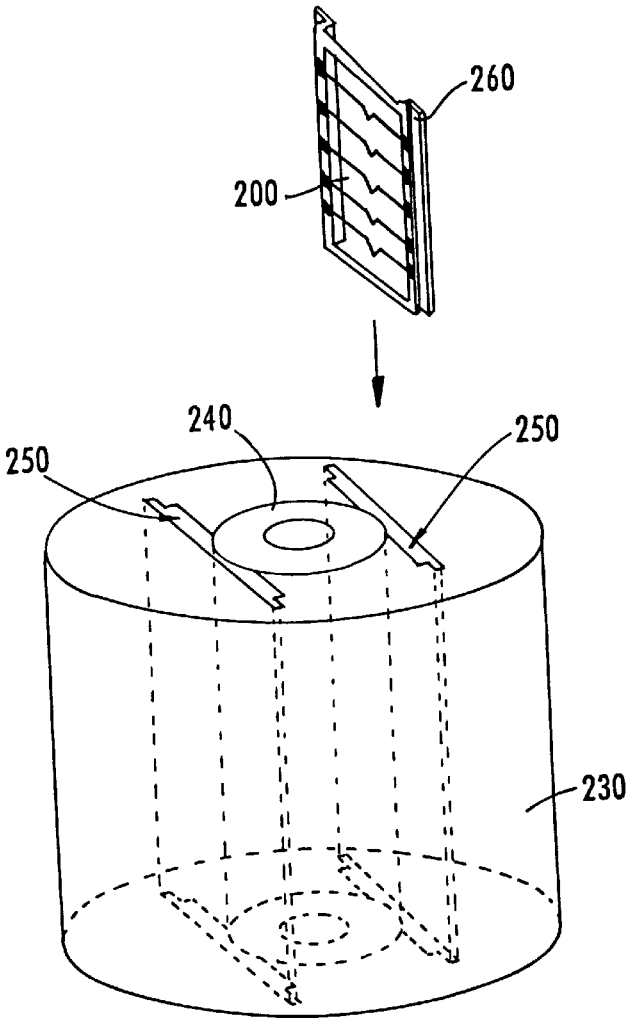
FIG. 2 is a schematic representation of a stationary pick up element for insertion into a housing, according to a first embodiment of the invention.
Figure 3:
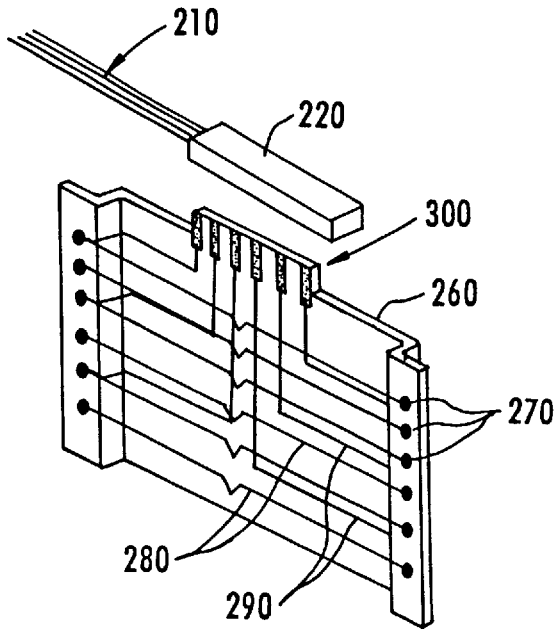
FIG. 3 is a detailed view of the stationary element and a wire connector of FIG. 2.
Figure 4:
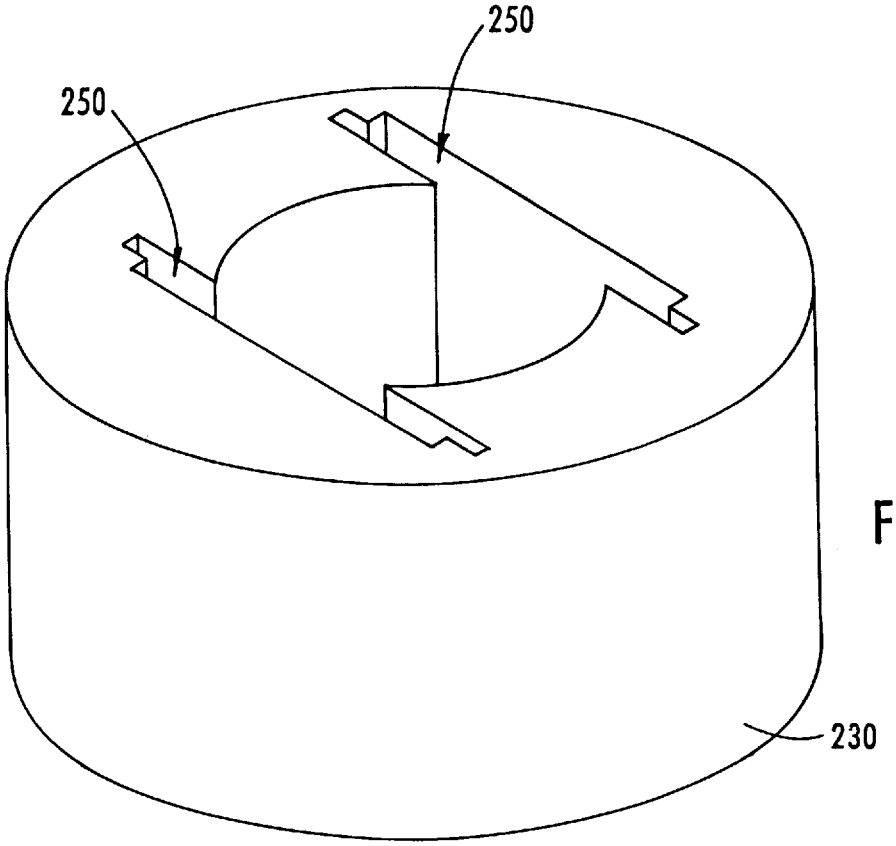
FIG. 4, show the stationary pick-up element and connector of FIG. 3 highlighting the pick-up wires or fingers (FIG. 3A) and conductive traces (FIG. 3B)
Figure 3A:
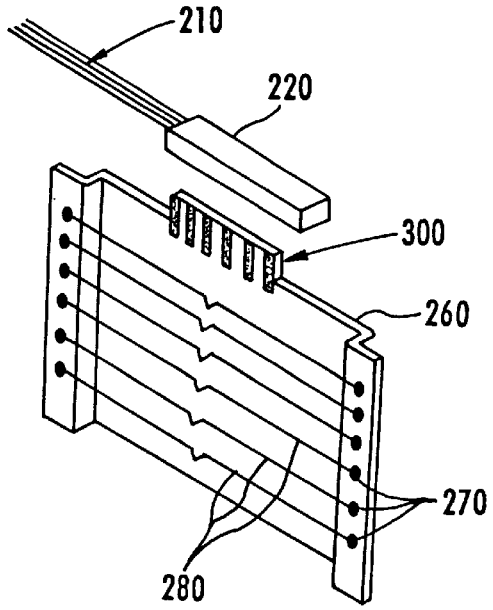
FIGS. 3A and 3B, appearing after
Figure 3B:
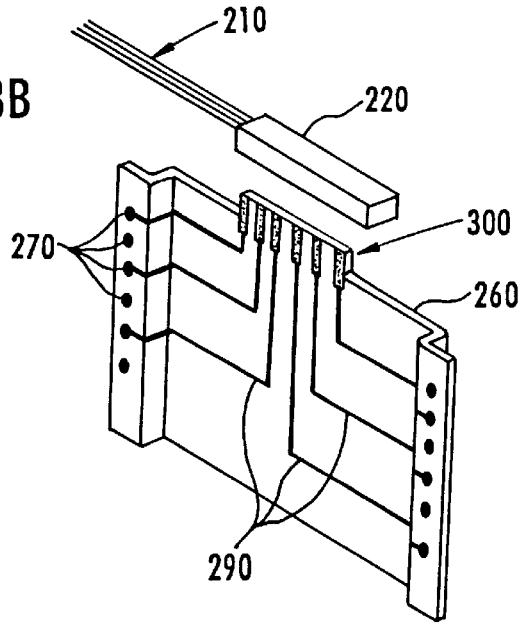
Figure 5:
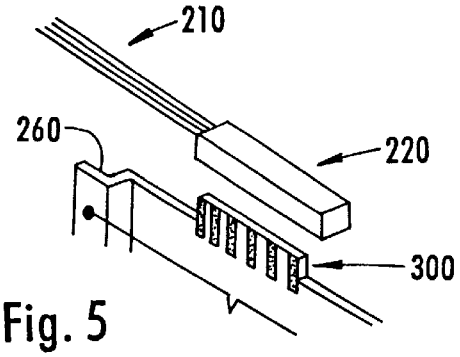
FIG. 5 is a detail showing the interface between the wire connector and an edge card connector of the stationary element.

Turning to the first embodiment of FIGS. 2, 3, 3A, 3B, 4 and 5, a stationary element 200 is provided for transmitting electrical signals between a plurality of external conductors in the form of wires 210 terminated on a connector 220, and a rotary connector of standard design disposed within housing 230. The rotary connector includes a wired rotary element 100 within a cavity 240. The housing 230 includes a pair of slots 250 (although only one slot may be provided, if desired) for receiving the stationary pick-up element 200. As shown best in FIGS. 2, 3 and 4, the slots 250 are dimensioned to receive element 200 in proper registration such that at least a portion of the slot 250 is exposed to the rotary element 100 for contact with the pick-up element. Appropriate dimensioning of the holder 260 and slots 250 result in proper alignment of the pick-up element 200 relative to the axis of revolution of rotary element 240 and proper force to maintain contact between the wires or conductive fingers 280 and the rotary device 240.

The stationary pick-up element 200 comprises an insulated holder 260 with selective plating on the surface to provide pads 270 for wire bonding of pick-up wires 280 and conductive traces 290. The conductive traces 290 are similar to well know PCB traces and extend between the wire bonded tabs 270 and a card edge connector 300. Since the mating connector 220 has wires 210 pre-terminated thereon, the connecting wires 210 can be simply "plugged" onto the stationary element rather than requiring soldering as in the prior art. However, it should be stressed that the connector 220 is not essential to the present invention. The pick-up wires 280 may be provided with a "kink" or a "coined" portion which contacts the rotary device 240. The wires 280 are preferably fabricated from the same gold alloy as the prior art fingers 180 (FIG. 1) resulting in similar durability and lifetime as prior art devices.

Turning now to FIGS. 6, 6A, 6B, 7A and 7B, a second embodiment of the invention is shown in which, rather than utilizing bonding wires 280 as in the first embodiment, a stamped and formed "comb" of pick-ups 600 is provided having a break-away carrier portion 610 and multiple pick-up elements or finger portions 620 which are attached to individual posts 624 of insulated holder of 626. After the fingers 620 have been attached to post 624, the carrier strip 610 is broken away via weakened portions 630 so that each individual pick-up finger 620 is isolated. As with the first embodiment, individual fingers 620 may be provided with a coined area 640 for improved electrical contact and wear against the rotary element.

Figure 6:
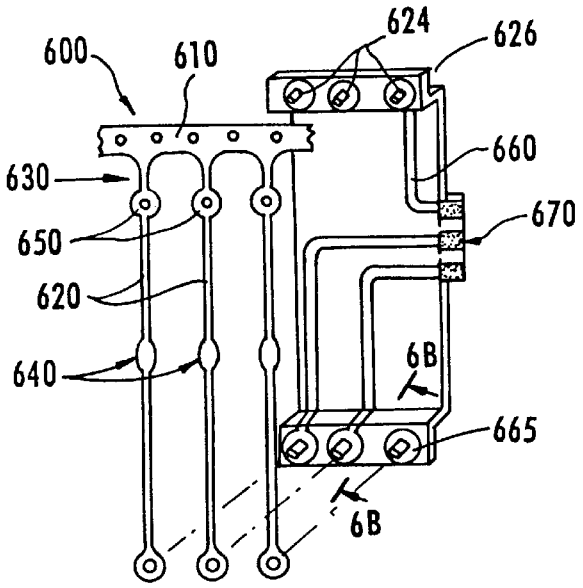
FIG. 6 shows the stationary element according to a second embodiment of the invention.
Figure 6A:
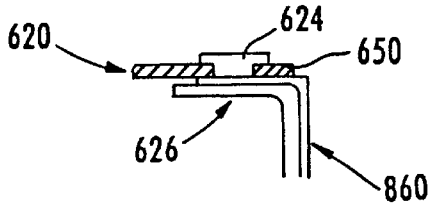
FIG. 6A is a cross-sectional view depicting a detail of the finger portions.
Figure 6B:
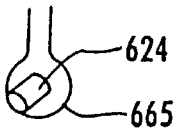
FIG. 6B is an isometric view of a single pick-up element and post along the lines 6B—6B of FIG. 6.

As shown in FIGS. 6A and 6*b*, annular connectors 650 are provided at distal portions of each finger 620 and are adapted to slide over the post 624. The post 624 is then heat staked over the distal connector 650 which forces the conductive finger 620 against a plated surface 665 surrounding the post 624 and in electrical connection with traces 660 on the holder body 626.

Figure 7A:
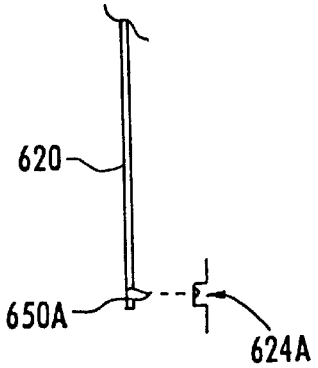
FIGS. 7A and 7B show variants of the interface between pick-up elements and posts for the second embodiment of FIG. 6.
Figure 7B:
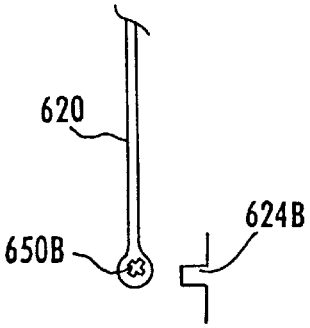

According to the variants of FIGS. 7A and 7B, rather than heat staking the posts 624 over the annular connectors 650 of fingers 620, a barb 650A or 650B can be press fit into or onto posts 624A or 624B, wherein the posts 624A and 624B are made conductive and coterminous with traces 660.

Figure 8:
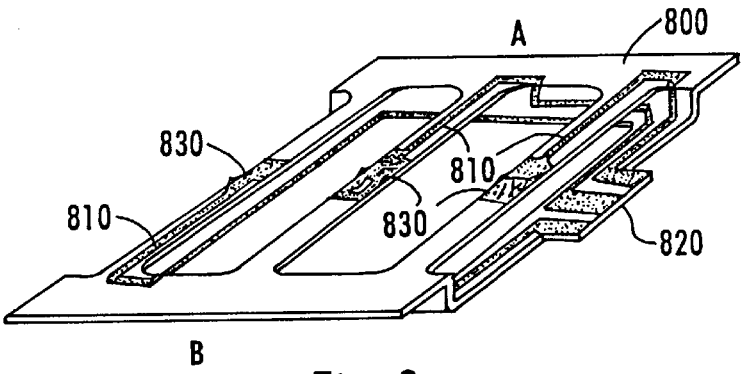
FIG. 8 is a perspective view of a stationary element with pick-ups according to a third embodiment of the invention.
Figure 8A:
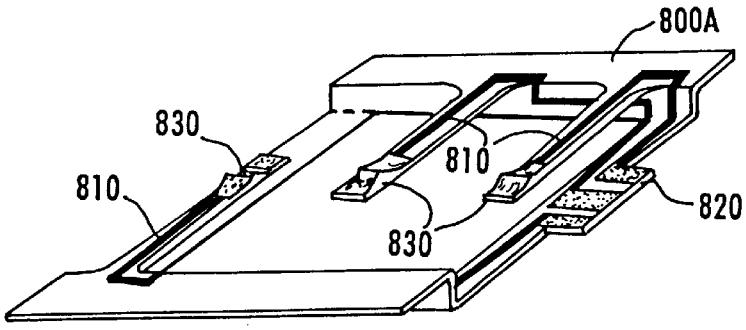
FIGS. 8A and 8B show variants of the third embodiment shown in FIG. 8.
Figure 8B:
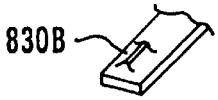

In the third embodiment of FIGS. 8, 8A and 8B, an all molded unit 800 is shown with only three traces 810 illustrated for simplicity. As with the prior embodiments, the traces 810 culminate in a card edge connector 820. The holder 800 is of total molded construction bridging from sides A to B. The conductive fingers comprise selectively plated traces 810 and built-up contact portions or brushes 830 terminating in the connector 820. Plating thickness and surface finish of the traces 810 and brushes 830 dictate durability and lifetime of the pick-up element as well as current rating. This embodiment is of lower cost than the prior discussed embodiments.

As shown in FIG. 8A, the insulative holder portion 800A need not bridge entirely across the device but may, instead, consist of one or more finger portions which end at brushes 830.

Also, as shown in FIG. 8B, a variant of the brush shape 830B may be provided for V-groove rings of the rotary element. Any geometry of contact portion or brush 830 may be provided, such as pointed, flat, rounded, etc.

With reference to the first, second and third embodiments discussed above, although card edge connectors 300, 670 and 820 are desirable, the card edge connectors can easily be replaced by solder pads with through-holes for simplified discrete wire attachment, or by pins to accept termination of flexible circuitry for input or output connections, or plated "forked" connection points for wire insulation displacement terminations.

Figure 9A:
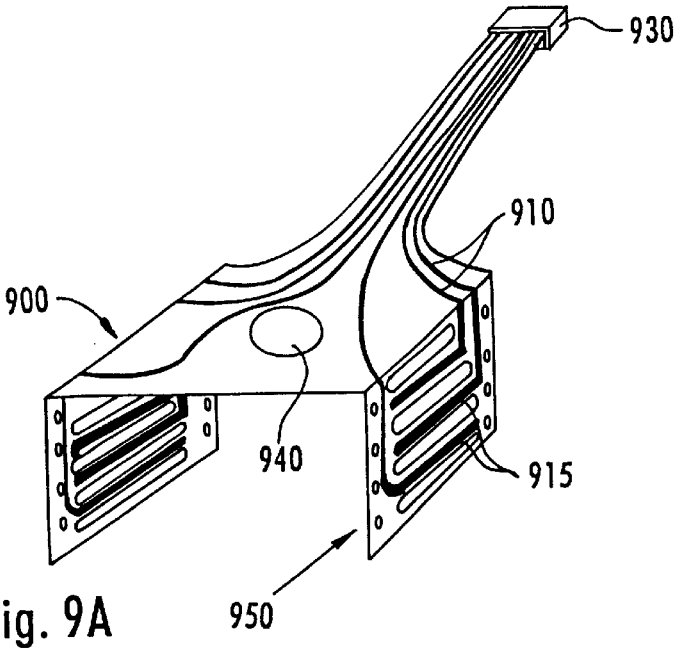
FIGS. 9A and 9B show a stationary element with pick-ups according to a fourth embodiment of the invention in folded and pre-folded conditions respectively.
Figure 9B:
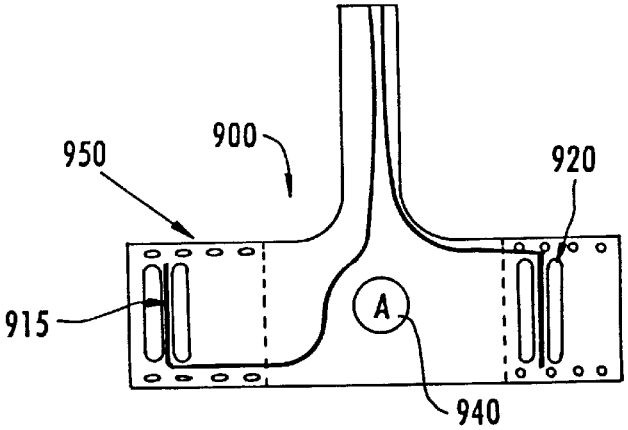

The fourth embodiment of FIGS. 9A and 9B utilizes a flat, flexible circuit 900 which is punched and folded such that, when inserted and retained in the housing of the associated rotary element, plated copper conductors or traces 910 contact the rotary element through center hole 940, so that electrical signals are communicated between the rotary element and a fixed element connected via connector 930.

Holes 920 are provided to allow the Flexible PC trace 910 to replicate a wire into the rotary element grooves 140 and electrically and mechanically contact the conductive rings within the grooves.

The embodiment of FIGS. 9A and 9B utilize standard flexible circuit technology wherein the pick-up portions 915 are one side of the traces 910 which has been exposed by removal of the protective film of circuit 900 by chemical, mechanical or heat processing steps. The output/input connector 930 can be attached to the flexible circuit 900 by conventional means, or alternatively can be configured to be a male PCB termination.

The conductive pick-ups 915 are held in position via a stretcher process to force the wires or traces 915 against the conductive rotary elements. Alternatively, the flexible circuit 900 can be bonded via adhesive or mechanically fixed various well known means.

The fourth embodiment of FIGS. 9A and 9B also provides a lower cost solution than the first two embodiments in exchange for shorter life and less durability.

The stationary pick-up of the present invention, as exemplified by the embodiments of FIGS. 2–9, provides a low cost alternative to labor-intensive prior art designs, and utilizes standard existing fabrication technologies. Although the invention has been described in relation to the four embodiments set forth above, other variations and embodiments are possible without departing from the sphere and scope of the invention as defined by the claims appended hereto.

I claim:

1. A stationary pick-up element transmitting electrical signals between a plurality of external conductors and a rotary connector, said rotary connector having a wired rotary element within a housing, at least a portion thereof being exposed to said rotary element, said stationary pick-up element comprising:

an insulated holder for insertion into said housing;

a plurality of conductive fingers incorporated into said holder and disposed so as to contact said rotary element through said exposed portion when said holder is inserted in said housing;

an end connector incorporated into said holder for connection to said plurality of external conductors; and a plurality of conductive traces on said insulated holder for connecting said conductive fingers to said end connector.

2. The stationary pick-up element of claim 1, wherein said insulated holder, end connector and conductive traces are fabricated as a printed circuit board.

3. The stationary pick-up element of claim 2, wherein said conductive fingers are in the form of wires which are bonded to respective ones of said plurality of conductive traces.

4. The stationary pick-up element of claim 3, wherein each of said wires incorporates a coined area for contacting said rotary element.

5. The stationary pick-up element of claim 2, wherein said insulated holder further includes a plurality of posts connected to said conductive traces and said conductive fingers are fabricated as a comb of pick-up elements with distal connectors adapted to engage respective ones of said posts, said comb of pick-up elements being stamped and formed with a removable carrier strip for aligning said distal connectors of said pick-up elements with respective ones of said posts during attachment of said distal connectors and said posts.

6. The stationary pick-up element of claim 5, wherein said conductive traces circumscribe said posts and said distal connectors are in the form of annuli adapted to fit over said posts so as to be in contact with said conductive traces, whereupon said posts are heat staked over said annuli.

7. The stationary pick-up element of claim 5, wherein said posts are plated thereby forming electrical connection to said conductive traces and said distal connectors are in the form of barbs adapted to press fit into said posts making electrical connection therewith.

8. The stationary pick-up element of claim 2, wherein said conductive fingers are in the form of plated finger portions of said holder extending across said exposed portions and electrically connected to said conductive traces.

9. The stationary pick-up element of claim 1, wherein said plurality of external conductors are wires which are terminated in a mating connector and said end connector comprises a card edge connector for receiving said mating connector.

10. The stationary pick-up element of claim 1, wherein said plurality of external conductors are wires and said end connector comprises a plurality of solder pads with through holes for terminating individual ones of said wires.

11. The stationary pick-up element of claim 1, wherein said plurality of external conductors are traces on a flexible circuit and said end connector comprises a plurality of pins for terminating said traces on said flexible circuit.

12. The stationary pick-up element of claim 1, wherein said plurality of external conductors are insulated wires and said end connector comprises a plurality of forked connection points for insulation displacement termination of said wires.

13. The stationary pick-up element of claim 1, wherein said insulated housing comprises a flexible circuit having a main body portion in a plane perpendicular to the axis of rotation of said rotary element, a hole in said main body portion for said rotary element to pass through, and a pair of foldable wings perpendicular to said main body portion for carrying said conductive traces, a portion of said wings being removed so as to expose said traces for contacting said rotary element.

* * * * *